US006327833B1

(12) United States Patent
Miskelley et al.

(10) Patent No.: US 6,327,833 B1
(45) Date of Patent: Dec. 11, 2001

(54) HOLLOW POLE WITH HOLLOW STUB FOUNDATION

(75) Inventors: Ricky W. Miskelley, Birmingham, AL (US); Bill Wier, Luray, SC (US)

(73) Assignee: Newmark International, Inc, Birmingham, AL (US)

( * ) Notice: Subject to any disclaimer, the term of this patent is extended or adjusted under 35 U.S.C. 154(b) by 0 days.

(21) Appl. No.: 09/384,773

(22) Filed: Aug. 27, 1999

(51) Int. Cl.[7] ..... E04C 3/30

(52) U.S. Cl. ..... 52/726.4; 52/295; 52/296; 52/297; 52/301; 52/40; 52/722.1; 52/169.3

(58) Field of Search ..... 52/296, 295, 297, 52/301, 722.1, 40, 726.4, 169.3

(56) References Cited

U.S. PATENT DOCUMENTS

| | | | | |
|---|---|---|---|---|
| 301,108 | | 7/1884 | Furness . | |
| 1,244,652 | | 10/1917 | Southgate . | |
| 1,712,757 | * | 5/1929 | Erskine | 52/296 |
| 1,819,733 | | 8/1931 | Castelli . | |
| 1,878,799 | * | 9/1932 | Ne Page | 52/295 |
| 1,906,508 | * | 5/1933 | Arbogast | 52/297 |
| 2,764,670 | | 9/1956 | Van Dusen, Jr. . | |
| 3,755,977 | | 9/1973 | Lewis . | |
| 3,936,206 | | 2/1976 | Meisberger . | |
| 3,974,372 | * | 8/1976 | Cochran | 240/84 |
| 3,988,870 | * | 11/1976 | Snavely | 52/296 |
| 4,617,768 | | 10/1986 | Begelius . | |
| 4,644,715 | | 2/1987 | Burell et al. . | |
| 4,813,199 | | 3/1989 | Lewis, Jr. . | |
| 4,815,731 | | 3/1989 | Schmanski . | |
| 4,920,715 | | 5/1990 | Parsons et al. . | |
| 5,055,987 | | 10/1991 | Ellson et al. . | |
| 5,060,437 | | 10/1991 | Parsons et al. . | |
| 5,076,032 | | 12/1991 | Lehman . | |
| 5,090,165 | * | 2/1992 | Kenny | 52/296 |
| 5,165,663 | | 11/1992 | Wells . | |
| 5,249,112 | | 9/1993 | Bray . | |
| 5,285,614 | | 2/1994 | Fouad . | |
| 5,383,749 | | 1/1995 | Reisdorff et al. . | |
| 5,398,478 | * | 3/1995 | Gordin et al. | 52/742 |
| 5,481,846 | | 1/1996 | Macchietto . | |
| 5,513,477 | | 5/1996 | Farber . | |
| 5,697,190 | | 12/1997 | Scribner . | |

* cited by examiner

*Primary Examiner*—Carl D. Friedman
*Assistant Examiner*—Christy M. Syres
(74) *Attorney, Agent, or Firm*—Theresa Fritz Camoriano; Camoriano and Associates

(57) ABSTRACT

A pole assembly includes two parts—a hollow stub foundation and a hollow pole, which telescopes over the stub foundation and rests on the ground. The stub and the pole preferably are adhered together. The stub preferably has a roughened outer surface at least in its upper portion to help it adhere to the inner surface of the pole when the two are assembled together. The stub has access openings to facilitate running wiring through the stub into the pole, and the pole preferably has an access opening that is aligned with an opening in the stub when the pole is installed on the stub to provide access for connecting wiring running inside the stub to wiring running inside the pole.

12 Claims, 4 Drawing Sheets

HOLLOW POLE WITH HOLLOW STUB FOUNDATION

BACKGROUND OF THE INVENTION

The present invention relates to fiberglass and other hollow poles. Fiberglass poles are often used for residential lighting, for parking lot lighting, and so forth. These poles have the advantage that they are lightweight, do not require a poured foundation, and can be made in decorative shapes to enhance the landscaping of an area. However, there have been some problems with these poles. Since the portion of the pole at ground level is often wider than the portion that goes below ground, it is often difficult or impossible to reach below the wide upper portion in order to tamp the base into position to secure it in place. Also, if the poles are set in place before the parking lot or adjacent sidewalks are paved or before landscaping is finished, which is usually necessary, there can be problems with the paving equipment or other landscaping equipment running into the pole and damaging it.

SUMMARY OF THE INVENTION

The present invention provides a pole foundation design and a method of installing the poles that permits the trenching to be dug, the wiring to be run, hollow stub foundations to be set, and the paving or other excavating or landscaping work to be done, and then the upper portions of the poles are set onto and are secured to the stub foundations, with holes aligned between the stub and the upper pole for running the wiring. This ensures that the poles are properly tamped in place and protects the poles from being damaged as landscaping, paving, or other work is done.

Figure 4:
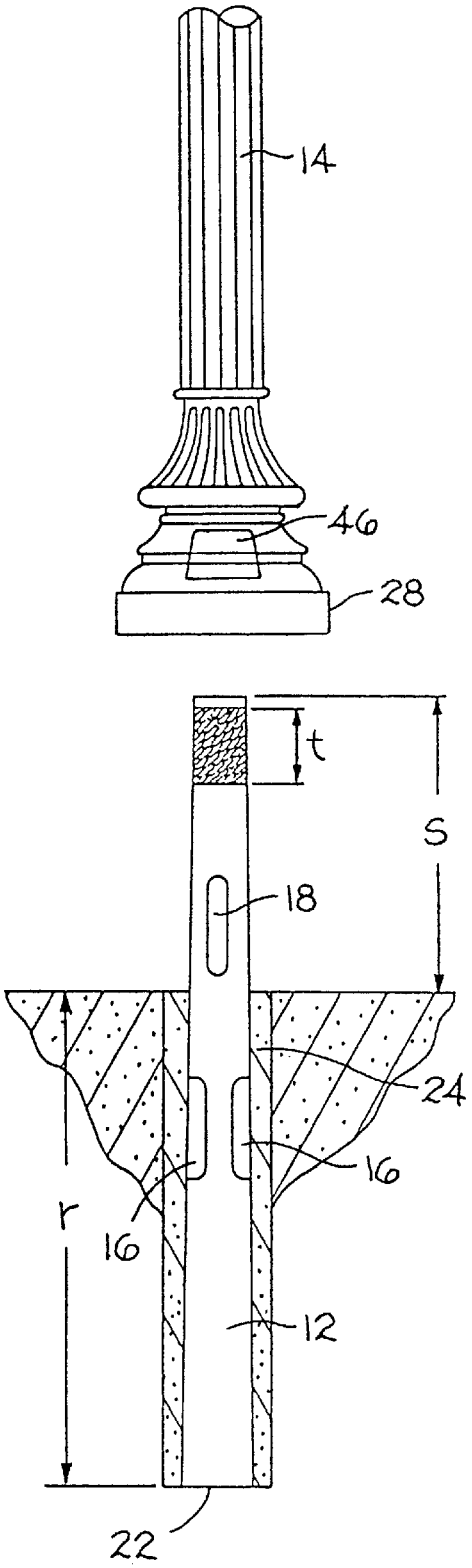
FIG. 4 is a front view of the pole being installed over the stub foundation.

DESCRIPTION OF THE PREFERRED EMBODIMENTS:

FIGS. 1–4 show a pole assembly 10, including a hollow stub foundation 12 and a pole 14, which mounts telescopically over the stub foundation 12. Both the stub foundation 12 and the pole 14 are hollow, tubular members. In this preferred embodiment, they are both made of fiberglass. It would also be possible to make the stub foundation and pole out of aluminum, steel, concrete, or other suitable materials. The stub foundation 12 shown here is 78 inches long. As shown in FIG. 4, the portion "r" of the stub foundation 12 is intended to go into the ground, and the portion "s" is intended to be above ground. The portion "t" is the uppermost portion of the stub foundation 12 and has a roughened outer surface which makes it easier to adhere the stub foundation 12 to the inside of the pole 14. In this preferred embodiment, the height "r" is four feet, the height "s" is thirty inches, and the height "t" is one foot.

In the below ground portion "r" of the stub foundation 12 are two opposed cable access slots (or lower slots) 16 through the side wall of the stub, which are approximately two inches wide and eight inches high. The bottom of each slot 16 is approximately 1.5 feet from the bottom of the stub foundation 12, so that the slots 16 can receive cable that is approximately from eighteen to thirty inches below ground level.

In the above ground portion "s" of the stub foundation 12 is an upper slot 18 through the side wall of the stub 12. The upper slot 18 is angularly located between the two lower slots 16 and is at a height approximately 1.5 feet above the lower slots 16 so that its bottom portion is just above ground level. While this arrangement of the upper and lower slots is preferred, it would also be possible to make a single slot that extends from below ground level to above ground level to perform the same function as the upper and lower slots 18, 16.

The stub foundation 12 preferably has a circular cross-section and is tapered, so that its diameter at the top 20 is less than its diameter at the bottom 22. This taper helps prevent the stub foundation 12 from rotating relative to the ground and from lifting up out of the ground, because the tapered side wall receives a component of force from the fill 24 acting downwardly on the outer surface 26 of the stub foundation 12. In this preferred embodiment, the upper portion has the same taper as the stub foundation 12. It would also be possible to make a straight, cylindrical stub foundation with a tapered pole, a tapered foundation with a straight pole, or both foundation and pole straight cylinders.

The pole 14 has a fluted tubular shape, with a wide base 28, approximately 25 inches in diameter. The diameter of the top 20 of the stub foundation 12 is approximately from four to sixteen inches, so the base 28 of the pole 14 is from one-and-one half to eight times, and preferably at least twice as wide as the top of the stub foundation 12. In the base 28 of the pole 14 is an access hole 30 through the side wall of the pole 14. The access hole 30 is just a few inches above the bottom of the base 28, so that it is aligned with the upper slot 18 of the stub foundation 12 when the stub foundation 12 is in the ground and the pole 14 is resting on the ground. The access hole 30 preferably is wider than the slot 18, and most preferably is at least four inches wide, so that the person wiring the pole can reach in through the access hole 30 to connect wiring running up the interior of the stub 12 to wiring running down the interior of the pole 14. There is a bottom plate 32 on the bottom of the base 28, and it has a central opening 34 and two opposed conduit openings 36. The central opening 34 is wider than the stub foundation 12, so that the pole 14 can easily be placed over the stub foundation 12. When the pole 14 is installed over the stub foundation 14, it completely encloses any portion of the stub that projects above the ground, so the stub 12 cannot be seen.

Figure 1:
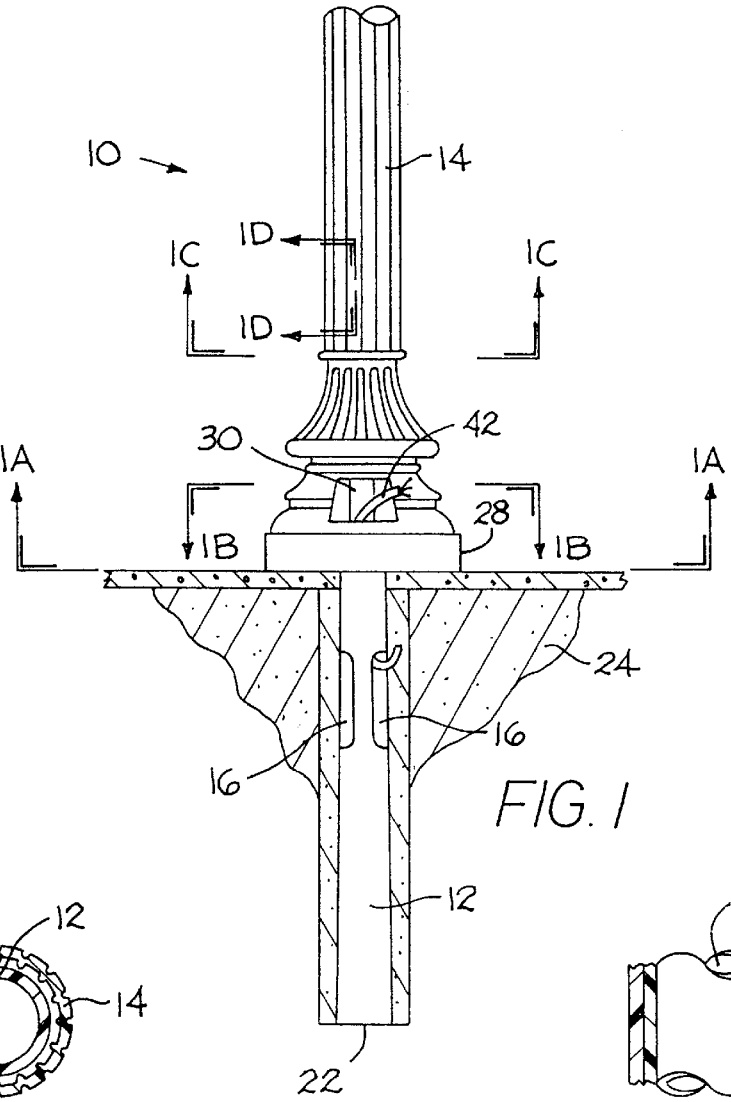
FIG. 1 is a front view of an installed pole made in accordance with the present invention.
Figure 1C:
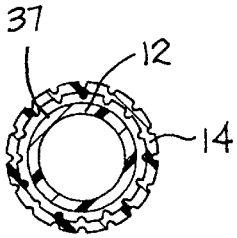
FIG. 1C is taken along the section 1C—1C of FIG. 1.
Figure 1D:
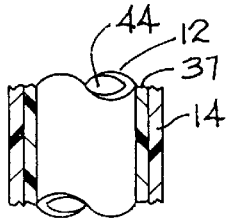
FIG. 1D is taken along the section 1D—1D of FIG. 1.
Figure 1A:
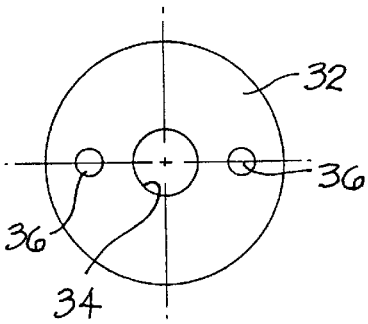
FIG. 1A is a view of the pole of FIG. 1 taken along the line 1A—1A, with the stub foundation removed.
Figure 1B:
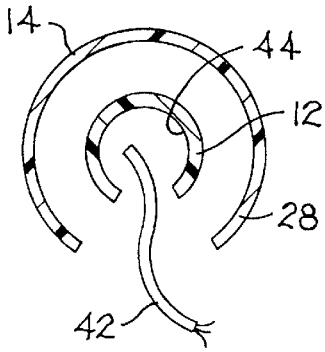
FIG. 1B is a view of the installed pole of FIG. 1 taken along the section 1B—1B.
Figure 2:
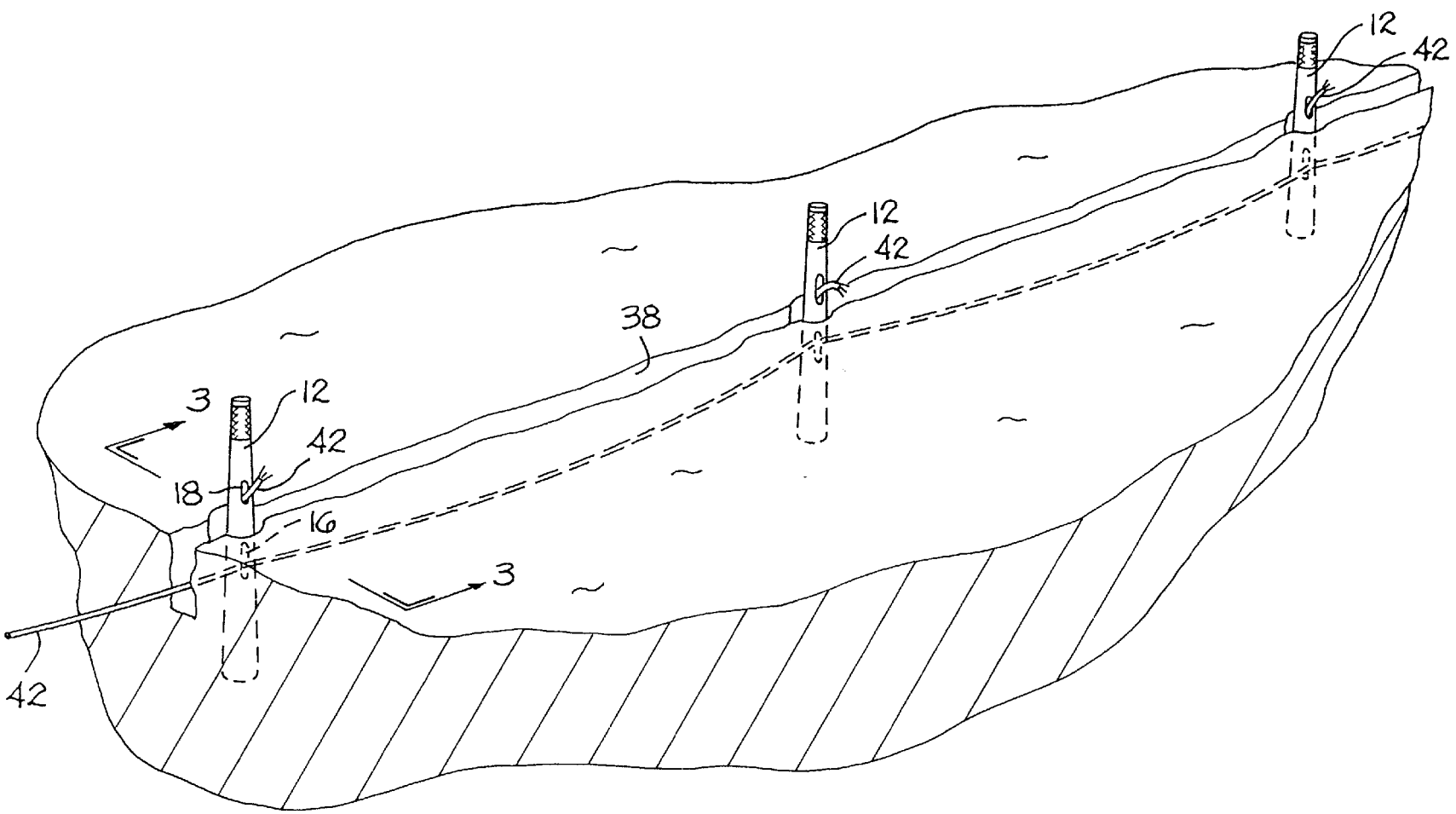
FIG. 2 is a perspective view of a plurality of hollow stub foundations being installed along a trench.
Figure 2A:
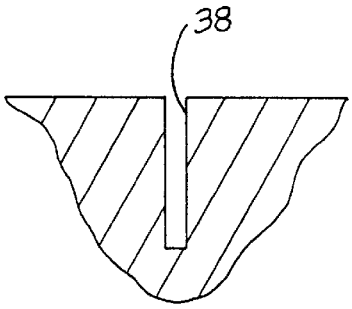
FIG. 2A is a view taken along the trench of FIG. 2 before the stub foundations are inserted.
Figure 3:
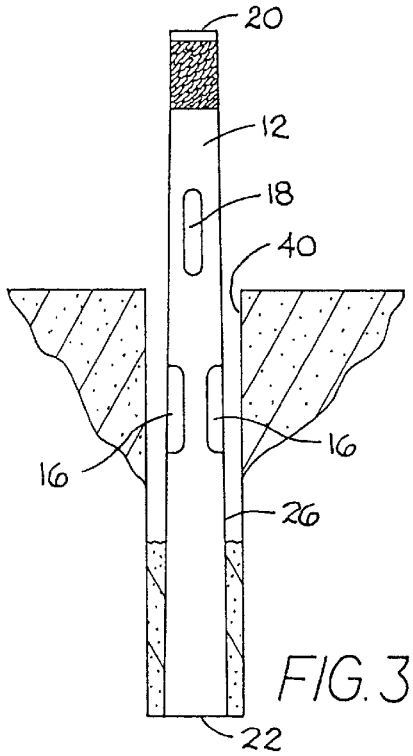
FIG. 3 taken along the line 3—3 of FIG. 2.
Figure 3A:
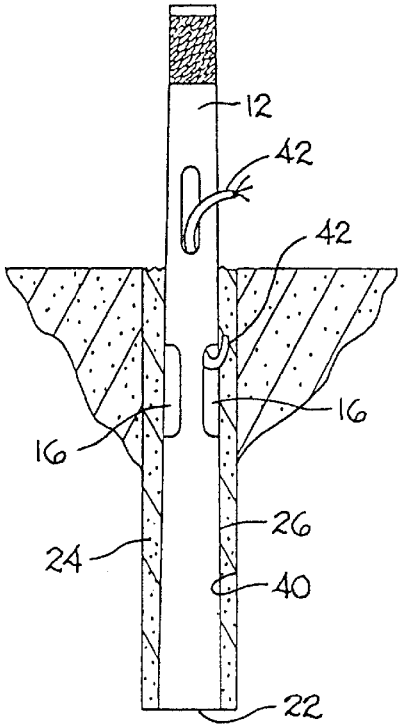
FIG. 3A is the stub foundation of FIG. 3 with wiring added.
Figure 3B:
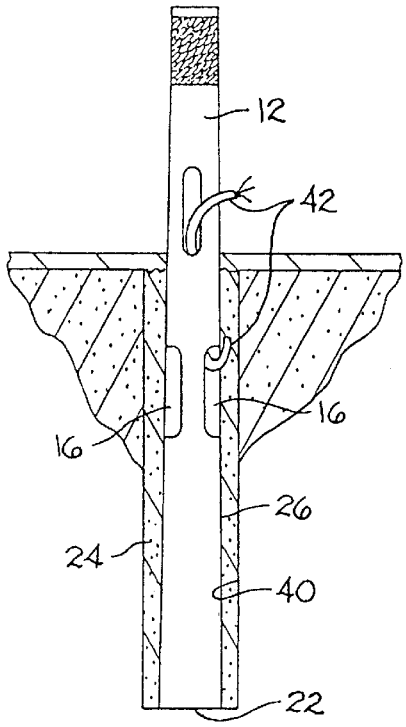
FIG. 3B is the stub foundation of FIG. 3A after backfill has been added and tamped and paving has been done.

As is shown in FIGS. 1C and 1D, the fluted portion of the pole 14 has an inside diameter that is just slightly larger than the diameter of the upper portion "t" of the stub foundation 12, and, once the pole 14 is telescoped over the stub 12, the pole and stub preferably are adhered together with an epoxy or other compatible adhesive 36. While connecting the stub foundation 12 and the pole 14 by adhesive is preferred, the two portions 12, 14 may also be connected just by a slip fit; they may be bolted together; or they may be joined by other known connecting mechanisms.

The pole 10 is installed as follows:

First, a trench 38 is dug to the width and depth required to run the wiring to the poles. Then, post holes 40 are dug at desired intervals along the trench, and the stub foundations 12 are inserted into the post holes 40 to a depth "r", and the post holes 40 are back-filled with fill dirt to the bottom of the trench. Then, the wiring 42 is laid along the bottom of the trench 38 and up through the respective lower slots 16 in the stub foundations 12 into the hollow centers 44 of the stub foundations, and out the upper openings 18. Then the post holes 40 and trench 38 are backfilled, and the post holes 40 are tamped to secure the stubs 12 in place.

Once the stubs 12 are wired and set, then any additional landscaping work that needs to be done can be done, such as paving streets and sidewalks, planting trees and shrubs, and so forth. Once the landscaping is done, the poles 14 are placed over the stubs 12, with the stubs 12 entering through the central openings 34 of the bottom plates 32 of the respective poles 14, so that the poles 14 are telescoped over the stub foundations 12. The base 28 of each pole 14 then rests on the ground (or on the sidewalk or pavement at ground level). The poles 14 preferably are pre-wired as desired, running wires to lights or other electrical devices mounted on the poles and extending the wires down through the interior of the poles 14. Before placing the poles 14 over their respective stubs 12, epoxy 37 or another compatible adhesive is placed on the outer surface of the stubs in the roughened area "t", and, once the epoxy or other adhesive sets, the stub foundation 12 and pole 14 are secured together to function as a single unit. When the pole 14 is telescoped over the stub 12, the upper opening 18 of the stub 12 is aligned with the access hole 30 in the pole 14. The hole 30 preferably is wider than the opening 18 of the stub 12 and is large enough that it permits an electrician to connect the wiring 42 coming up through the stub foundation 12 to the wiring in the pole 14. The hole 30 is then covered with a cover plate 46.

Since, in the preferred embodiment, the pole 14 and foundation 12 are not fitted together with a tight, interference fit, there is enough play to permit some variations in the depth to which the stub 12 is set and the amount of the stub that must project into the pole 14 in order for the pole to reach ground level. If the stub and pole 12, 14 are adhered together, they function as a single, unitary assembly once they are installed.

Figure 5:
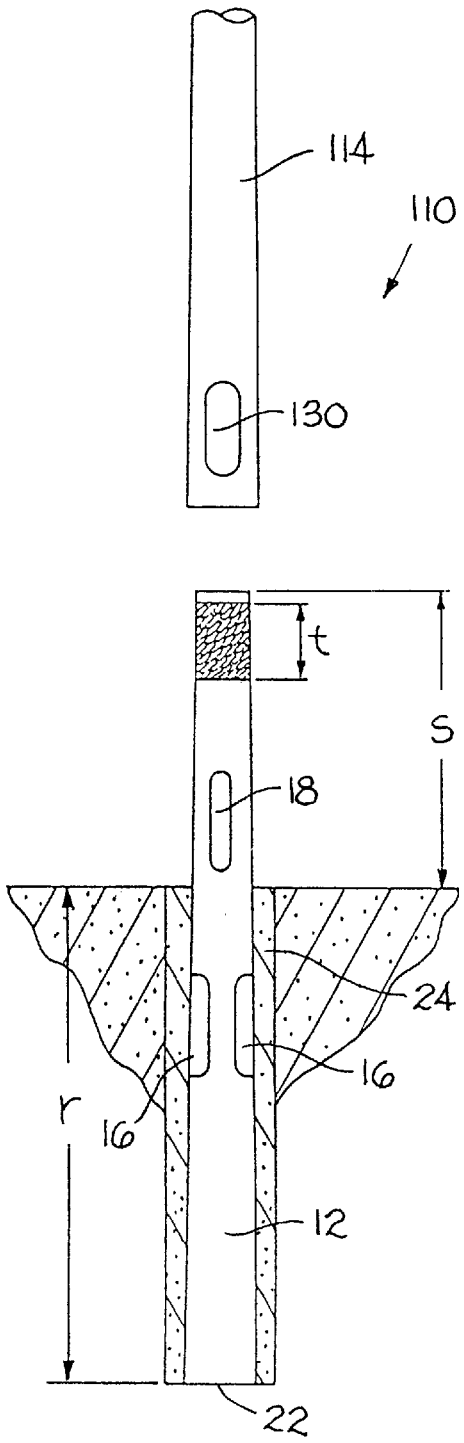
FIG. 5 is the same view as FIG. 4 but showing a differently-shaped pole being mounted over the same foundation.

FIG. 5 shows an alternative embodiment of a pole assembly 110, which is identical to the first pole assembly 10, except that the pole 114 is a simple, tapered, hollow pole rather than being fluted and having a wide base as in the first embodiment. The hole 130 of this pole 114 performs the same function as the hole access 30 of the previous embodiment, and the pole 114 is adhered to the stub 12 as in the previous embodiment.

In both the first and second embodiments, the stub extends approximately 2.5 feet up into the pole and approximately four feet into the ground, while the pole may extend from eight to forty feet above ground level. For taller poles, up to seventy feet above ground level, the stub extends approximately five feet above the ground and nine feet below the ground. So the stub generally would extend into the pole for one-third or less of the height of the pole.

It will be obvious to those skilled in the art that modifications may be made to the embodiments described above without departing from the scope of the present invention.

What is claimed is:

1. A pole assembly, comprising:

a tubular, hollow stub foundation, having a top and a bottom, an outer surface and an inner surface, and including a below ground cable access opening from the outer surface to the inner surface and an above ground cable access opening from the outer surface to the inner surface;

a hollow pole having a top and a bottom, an external surface and an internal surface; wherein the bottom of the hollow pole is open, and the internal surface receives the outer surface of the stub foundation with a close fit; and defining a hole extending from the external surface to the internal surface of the pole, wherein the above ground cable access opening in said hollow stub foundation is at a greater height from the bottom of the stub than the hole in the pole is from the bottom of the pole, and the stub and pole are sized and the above ground cable access opening and the hole in the pole are located such that, upon insertion of the bottom of the stub foundation into the ground with the top of the stub projecting above the ground, and upon placing the pole over the stub and resting on the ground, the above ground cable access opening in said hollow stub foundation is aligned with said hole in the pole.

2. A pole as recited in claim 1, wherein the outer surface at the upper portion of the stub has a roughened texture to promote adhesion of the stub to the pole.

3. A pole as recited in claim 1, wherein said stub is tapered, so that its diameter at the bottom is greater than its diameter at the top.

4. A pole as recited in claim 1, wherein the base of said pole is at least one-and-one-half times the diameter of the upper portion of the stub.

5. A pole as recited in claim 1, wherein the stub and pole are made of fiberglass and are adhered together.

6. A pole kit, comprising:

a hollow stub foundation having top and bottom ends and a side wall defining a below ground opening through the stub foundation side wall and an above ground opening through the stub foundation side wall; and a hollow pole having top and bottom ends and having a pole side wall defining a hole through the pole side wall, wherein the outside diameter at the bottom end of said pole is at least one-and-one-half times the diameter at the top end of said stub foundation; and wherein said hollow pole has an Inner surface sized to receive the top end of the stub foundation with a close fit such that, upon burying the bottom end of the stub foundation in the ground, and upon telescoping the pole over the top end of the stub foundation with a close fit between the stub and the pole, the above ground opening in the side wall of said stub aligns with the hole in the pole.

7. A pole kit, as recited in claim 6, wherein the outer surface of said stub is roughened at least near the top to facilitate adhesion to the pole.

8. A kit as recited in claims 6, and further comprising an adhesive for adhering the stub and pole together.

9. An installed pole, comprising:

a tubular, hollow stub foundation, having a top and a bottom and a side wall, wherein the bottom of the stub foundation is buried in the ground, and the top of the stub foundation projects up out of the ground and there is a below around opening through said side wall and an above ground opening through said side wall;

a hollow pole having a top and a bottom, and a pole wall defining an external surface and an internal surface and a hole through said pole wall; wherein the bottom of the hollow pole is open, and the internal surface receives the outer surface of the stub foundation with a close fit, and the bottom of the hollow pole rests on the ground, so that the hollow pole surrounds the portion of the stub foundation that projects up out of the ground and the hole through the pole wall is aligned with the above ground opening in the foundation.

10. An installed pole as recited in claim 9, wherein said stub foundation and said hollow pole are adhered together.

11. A method of installing poles, comprising the steps of:

digging a trench to run wiring underground;

digging post holes along the trench to receive poles;

inserting hollow tubular stub foundations in the post holes, said hollow stub foundations having openings in their side walls near the height of the bottom of the trench and openings in their side walls above ground;

running wiring along the trench and into the openings of the stubs at trench height and up the stubs;

filling the trench and the post holes and tamping the stubs into their respective post holes;

telescoping hollow poles over the respective hollow stubs, securing the respective poles and hollow stubs together, with the bottom of the poles resting on the ground and the hollow stubs extending part-way up inside the respective poles; and aligning holes in the poles with the above ground openings in the stub foundations.

12. A method of installing poles as recited in claim 11, and further comprising the step of reaching through the respective aligned holes in the poles and openings in the stubs to connect wiring running up the interior of the stubs to wiring running down the interior of the poles.

* * * * *

UNITED STATES PATENT AND TRADEMARK OFFICE

CERTIFICATE OF CORRECTION

PATENT NO. : 6,327,833 B1
DATED : December 11, 2001
INVENTOR(S) : Ricky Miskelley and Bill Wier It is certified that error appears in the above-identified patent and that said Letters Patent is hereby corrected as shown below:

Claim 6,
Line 55, delete "Inner" and insert therefor -- inner --.

Claim 9,
Line 6, delete "around" and insert therefore -- ground --.

Signed and Sealed this

Sixteenth Day of April, 2002

*Attest:*

*Attesting Officer*

JAMES E. ROGAN
*Director of the United States Patent and Trademark Office*